US005246058A

United States Patent [19]

Murata

[11] Patent Number: 5,246,058

[45] Date of Patent: Sep. 21, 1993

[54] FLASKLESS MOLDING MACHINE

[75] Inventor: Yutaka Murata, Toyokawa, Japan

[73] Assignee: Sintokogia Ltd., Nagoya, Japan

[21] Appl. No.: 724,667

[22] Filed: Jul. 2, 1991

[30] Foreign Application Priority Data

Jul. 27, 1990 [JP] Japan ..... 2-200778

[51] Int. Cl.[5] ..... B22C 11/00; B22C 15/28

[52] U.S. Cl. ..... 164/182; 164/183; 164/195; 164/201

[58] Field of Search ..... 164/201, 200, 182, 183, 164/195, 180

[56] References Cited

U.S. PATENT DOCUMENTS

| | | | |
|---|---|---|---|
| 3,589,431 | 6/1971 | Fellows | 164/201 X |
| 4,437,507 | 3/1984 | Seeley | 164/187 X |
| 4,463,794 | 8/1984 | Shioda | 164/182 |

FOREIGN PATENT DOCUMENTS

| | | | |
|---|---|---|---|
| 55-126344 | 9/1980 | Japan | 164/195 |
| 56-68550 | 6/1981 | Japan | 164/200 |
| 58-68453 | 4/1983 | Japan | 164/195 |
| 59-24552 | 2/1984 | Japan | 164/201 |
| 62-45017 | 9/1987 | Japan | 164/182 |
| 1-299743 | 12/1989 | Japan | 164/200 |
| 2-16829 | 5/1990 | Japan . | |

*Primary Examiner*—J. Reed Batten, Jr.

*Attorney, Agent, or Firm*—Armstrong, Westerman Hattori, McLeland & Naughton

[57] ABSTRACT

The flaskless molding machine includes a drag flask arranged so as to be rotated between a horizontal position and a vertical position, a cope flask arranged so as to be moved up and down when the drag flask takes its horizontal position and to be also rotated between a horizontal position and a vertical position in association with the rotation of the drag flask, and a squeeze plate for the cope flask arranged in the mold flask so as to be movable therein between the upper and lower openings of the cope flask.

1 Claim, 9 Drawing Sheets

FLASKLESS MOLDING MACHINE

BACKGROUND OF THE INVENTION

The present invention relates to a flaskless molding machine, and, more particularly, to a flaskless molding machine of a type in which a cope flask, a match plate and a drag flask are capable of rotating by an angle of 90° between their horizontal positions and vertical positions, the above-described three elements take their vertical positions to perform charging and compacting sand and flask separation is performed when they take their horizontal positions.

DESCRIPTION OF THE RELATED ART

A conventional flaskless molding machine of the above-described type has been, for example, disclosed in Japanese Patent Utility Model Examined Publication No. 2-16829, arranged in such a manner that a squeeze plate for compacting sand and a pressure plate for separating the mold from flask are individually provided. Therefore, there has been raised a problem in that the overall size of the apparatus including the flaskless molding machine cannot be reduced. Furthermore, the squeeze plate for the cope flask is fastened to the frame of the machine and is arranged to be introduced into the cope flask when the cope flask takes its vertical position. However, it is difficult for the rotating cope flask to accurately stop at a predetermined position. Therefore, the above-described squeeze plate cannot always smoothly be introduced into the cope flask due to the positional deviation.

BRIEF SUMMARY OF INVENTION

Accordingly, an object of the present invention is to provide a flaskless molding machine the overall size of which can be reduced and the squeeze plate of which can be smoothly introduced into the cope flask.

In order to solve the above-described problems, the present invention is characterized in that a squeeze plate for squeezing the cope flask and as well as for separating the mold flask is integrally provided with the cope flask.

That is, according to an aspect of the present invention, there is provided a flaskless molding machine comprising: a drag flask disposed so as to be rotated between a horizontal position and a vertical position; a cope flask disposed so as to be moved up and down with respect to the position of the drag flask when the drag flask takes its horizontal position and to be also rotated between a horizontal position and a vertical position in association with the rotation of the drag flask; and a squeeze plate for the cope flask inserted into the cope flask so as to be moved reciprocally between an upper opening position and a lower opening position of the cope flask.

According to the present invention thus-constituted, the squeeze plate for the cope flask also serves as a pressure plate for the mold-flask separation. Therefore, the overall size of the apparatus including the flaskless molding machine can be reduced. Furthermore, since the squeeze plate for the cope flask is integrally provided with the cope flask, the risk of the positional deviation due to the rotation of the cope flask can be prevented. Consequently, movement of the squeeze plate can be always performed smoothly.

These and other objects, features and advantages of the present invention will be more fully apparent from the following detailed description taken in conjunction with the accompanying drawings in which:

BRIEF DESCRIPTION OF THE DRAWINGS

FIGS. 1 to 9 are transverse sectional views illustrating an embodiment of the present invention, among which FIG. 1 shows a condition just before a mold forming operation, FIG. 2 shows a condition in which a match plate is introduced, FIG. 3 shows a condition in which mold flasks are aligned and mated with the match plate, FIG. 4 shows a condition in which the mold flasks are rotated to their vertical positions, and a blow head is introduced, FIG. 5 shows a condition in which sand is charged, FIG. 6 shows a condition in which the charged sand is compacted, FIG. 7 shows a condition in which the mold flasks and mold halves are rotated to their vertical positions, FIG. 8 shows a condition in which the match plate is separated from the mold halves, and, FIG. 9 shows a condition in which the mold halves are parted from the mold flasks.

DETAILED DESCRIPTION OF THE PREFERRED EMBODIMENTS

FIGS. 1 to 9 are front elevational vertical cross sectional views illustrating the process of manufacturing a flaskless mold halves by means of an apparatus according to the present invention.

Figure 1:
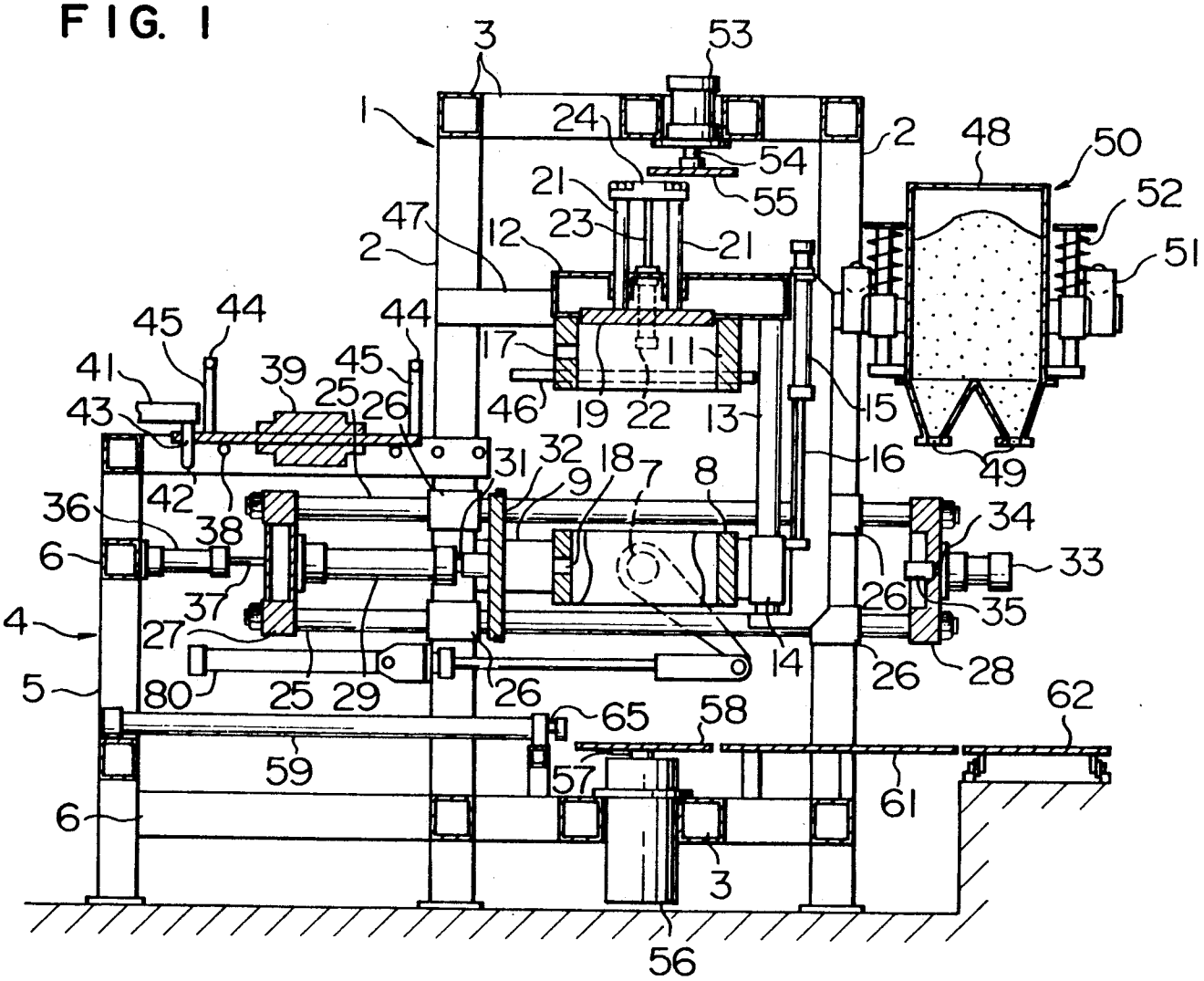

Referring to FIG. 1, reference numeral 1 represents a main-gate type frame comprising pairs of columns 2, each of the pairs being composed of two columns 2. The main-gate type frame 1 further comprises a multiplicity of beam members 3 for longitudinally and laterally connecting the columns 2 to each other. Reference numeral 4 represents a sub-gate type frame comprising a pair of columns 5 disposed longitudinally and a multiplicity of beam members 6 for longitudinally connecting the columns 5 to each other and connecting the columns 5 to the left portion of the above-described main-gate type frame 1.

At substantially the intermediate level of the above-described main-frame type frame 1, a drag flask 8 having trunnions 7 formed on the lateral two side walls thereof is, via these trunnions 7, pivotally supported by a pair of support members 9 disposed longitudinally and respectively arranged between the columns 2 disposed laterally. The drag flask 8 can be rotated by an angle of 90° between a horizontal position and a vertical position by a rotation drive mechanism 80 (see FIG. 1). However, the rotation drive mechanism 80 is omitted from FIGS. 2 to 9.

A cope flask fastening frame 12 is disposed above the drag flask 8, the cope flask fastening frame 12 being formed into a box shape to which the cope flask 11 is secured on the lower surface thereof. A pair of guide rods 13 disposed longitudinally are suspended from the lower surface of the right end portion of the above-described cope flask fastening frame 12. The above-described guide rods 13 are inserted into a pair of guide pipes 14 longitudinally secured to the right end surface of the above-described drag flask 8 in such a manner that the guide rods 13 are able to slide in the guide pipes 14. A pair of cylinders 15 longitudinally disposed are downward fastened to the right end surface of the above-described cope flask fastening frame 12. The lower end of a piston rod 16 of each of the cylinders 15 is connected to the side portion of each of the guide pipes 14. As a result, the above-described cope flask fastening frame 12 and the cope flask 11 can be moved up and down when the piston rods 16 extend and retract. The cope flask fastening frame 12 and the cope flask 11 can be, together with the drag flask 8, rotated by an angle of 90° between the horizontal positions and the vertical positions around the trunnions 7 of the drag flask 8. The cope flask 11 and the drag flask 8 respectively have, on the left wall thereof, sand charging ports 17 and 18 each of which is formed into a shape cf a through-hole.

A cope flask squeeze plate 19 formed into a rectangular shape is movably fitted within the above-described cope flask 11. The cope flask squeeze plate 19 has, on the back side thereof, a pair of guide rods 21 disposed laterally to stand erect. The upper end of each of the guide rods 21 passes through and projects upward from the top surface of the cope flask fastening frame 12. A pair of cylinders 22 facing upward are disposed on the lateral two side surfaces of the cope flask fastening frame 12. The upper ends of piston rods 23 of the cylinders 22 are connected to the upper ends of the guide rods 21 via connecting bracket 24. Therefore, when the piston rods 23 extend or retract, the above-described cope flask squeeze plate 19 moves up and down between the upper opening and the lower opening in the cope flask 11.

Guide rods 25 arranged horizontally are longitudinally and laterally disposed along the two side walls of the drag flask 8 adjacent to the trunnions 7. The guide rods 25 thus-disposed are inserted into guide cylinders 26 secured to the support columns 2 of the above-described main-gate type frame 1 so as to be able to move in the axial direction. The guide rods 25 are connected to each other at their lateral end portions by die bases 27 and 28. A cylinder 29 facing right is fastened to the left-hand die base 27, the cylinder 29 having a piston rod 31 to which a rectangular drag flask squeeze plate 32 is fastened at the free end thereof. The drag flask squeeze plate 32 can be inserted into the lower opening of the drag flask 8 when the drag flask 8 takes its vertical position. Furthermore, a cylinder 33 facing left is fastened on the outer surface of the right-hand die base 28, the cylinder 33 having a piston rod 34 which penetrates the die base 28 to project leftward. A squeeze head 35 is secured to the free end of the piston rod 34. The left-hand die base 27 is connected to the free end of a piston rod 37 of a positioning cylinder 36 facing right and fastened to the beam members 6 of the sub-gate type frame 4 disposed laterally. A roller conveyance path 38 is laterally formed in the upper portion of the sub-gate type frame 4, the conveyance path 38 having a match plate 39 placed thereon in such a manner that the match plate 39 can be moved horizontally.

Reference numeral 41 represents an arm which can be horizontally moved by a drive means (omitted from illustration), the arm 41 having a pin 42 downward secured to the free end thereof. The pin 42 is, with a permitted certain play, inserted into a pin hole 43 formed to penetrate from the top surface at the left-hand end of the match plate 39 to the bottom surface of the same. The match plate 39 has suspending members 45 at the four corners of the top surface thereof, each of the suspending members 45 having a roller 44 at the top end portion thereof. The above-described cope flask 11 has, on the lateral two side surfaces thereof, rails 46 disposed horizontally to correspond to the rollers 44. When the arm 41 is expanded at the moment at which the cope flask 11 takes its uppermost position, the match plate 39 is placed on the rail 46 via the suspending members 45 so as to be suspended below the cope flask 11.

At the upper level in the above-described main-gate type frame 1, a pair of rails 47 supported by the right-hand and the left-hand support columns 2 and extending to right by a predetermined length are laterally disposed. A blow head 50 formed into a box-like shape and having a sand inlet port 48 on the top surface thereof and sand blowing ports 49 arranged laterally in a juxtaposed relation and formed at the lower end portion thereof are placed on the rail 47 via a roller carrier 51 in such a manner that the blow head 50 can be moved laterally, accommodating sand. The blow head 50 can be reciprocated by a drive means (omitted from illustration) between a predetermined position in the main-gate type frame 1 and the outside position rightward from the above-described frame 1. The blow head 50 is supported by the roller carrier 51 via spring members 52 in such a manner that the blow head 50 can be vertically moved. A cylinder 53 facing downward is disposed adjacent to the above-described main-gate type frame 1 in such a manner that it is supported by the beam member 3 arranged laterally. A disc-like pressing plate 55 having a diameter larger than that of the sand inlet port 48 of the blow head 50 is secured to the lower portion of a piston rod 54 of the cylinder 53.

At a lower level of the main-gate type frame 1, a telescopic cylinder 56 facing upward is disposed in such a manner that it is supported by the beam member 3 arranged laterally. A rectangular table 58 is secured to a piston rod 57 of the cylinder 56, the table 58 being arranged in such a manner that it can be introduced into the lower opening of the drag flask 8 when the drag flask 8 takes its horizontal position. Reference numeral 59 represents a cylinder for conveying a mold halves placed on the above-described table 58 to a mold-half conveyance carrier 62 via a transportation member 61.

Then, a manufacturing process of molding a flaskless mold halves by means of the flaskless molding machine thus-constituted will now be described with reference to FIGS. 1 to 9.

Figure 2:
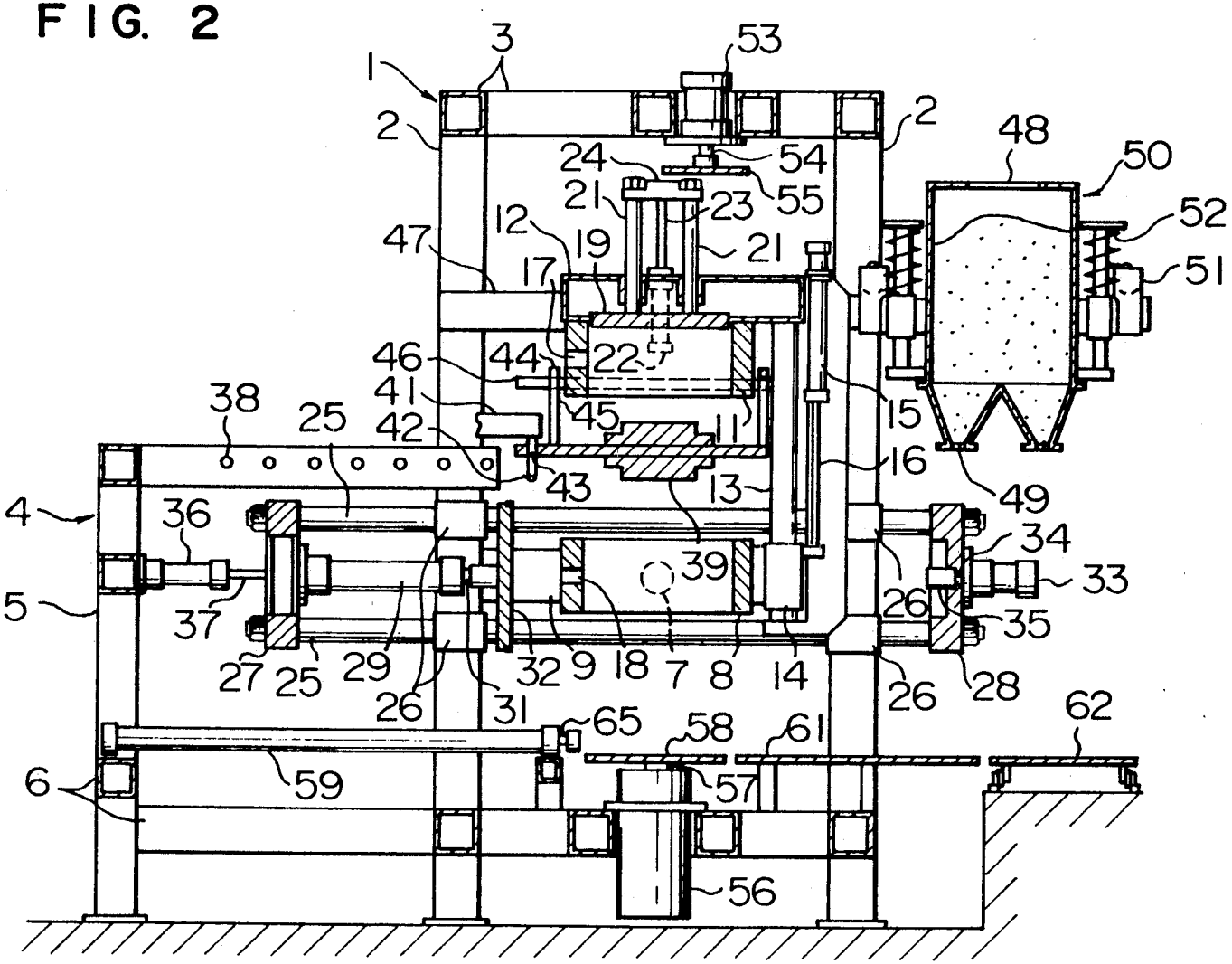
Figure 3:
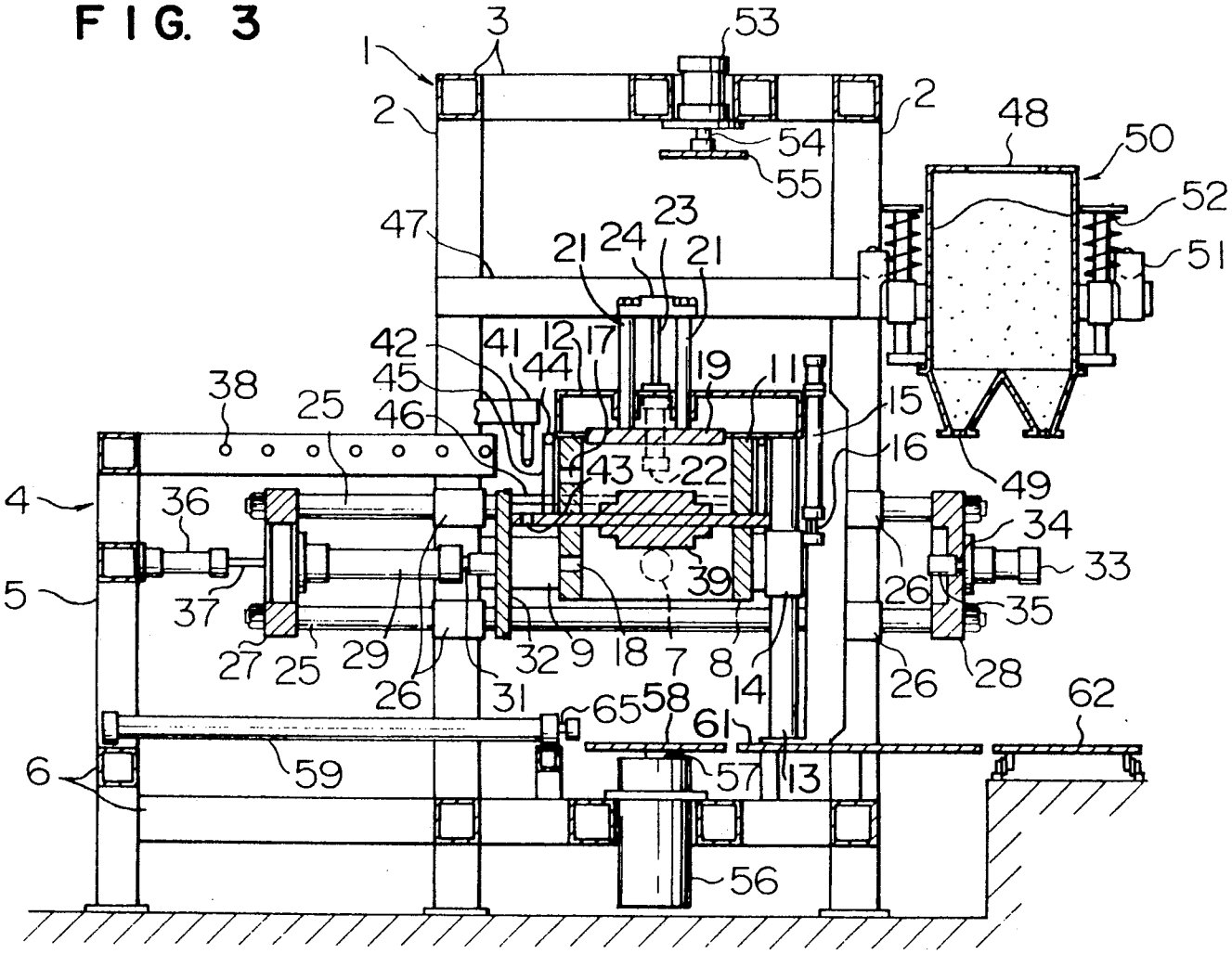

In a condition shown in FIG. 1, as a first manufacturing step, the arm 41 is extended so as to move the match plate 39 to a position between the cope flask 11 and the drag flask 8 (see FIG. 2).

As a second manufacturing step, the piston rod 16 of the cylinder 15 is retracted so as to downward move the cope flask 11 together with the cope flask fastening frame 12. As a result, the match plate 39 is placed on the drag flask 8, and then the lower end portion of the cope flask 11 comes in contact with the top surface of the match plate 39. Therefore, the above-described three elements are integrally set to each other (see FIG. 3). At this time, the condition in which the pin 42 of the arm 41 is inserted into the pin hole 43 formed in the match plate 39 is released.

As a third manufacturing step, the cope flask fastening frame 12, the cope flask 11, the match plate 39 and the drag flask 8 are clockwise rotated together by an angle of 90° by a rotation drive mechanism (omitted from illustration).

Figure 4:
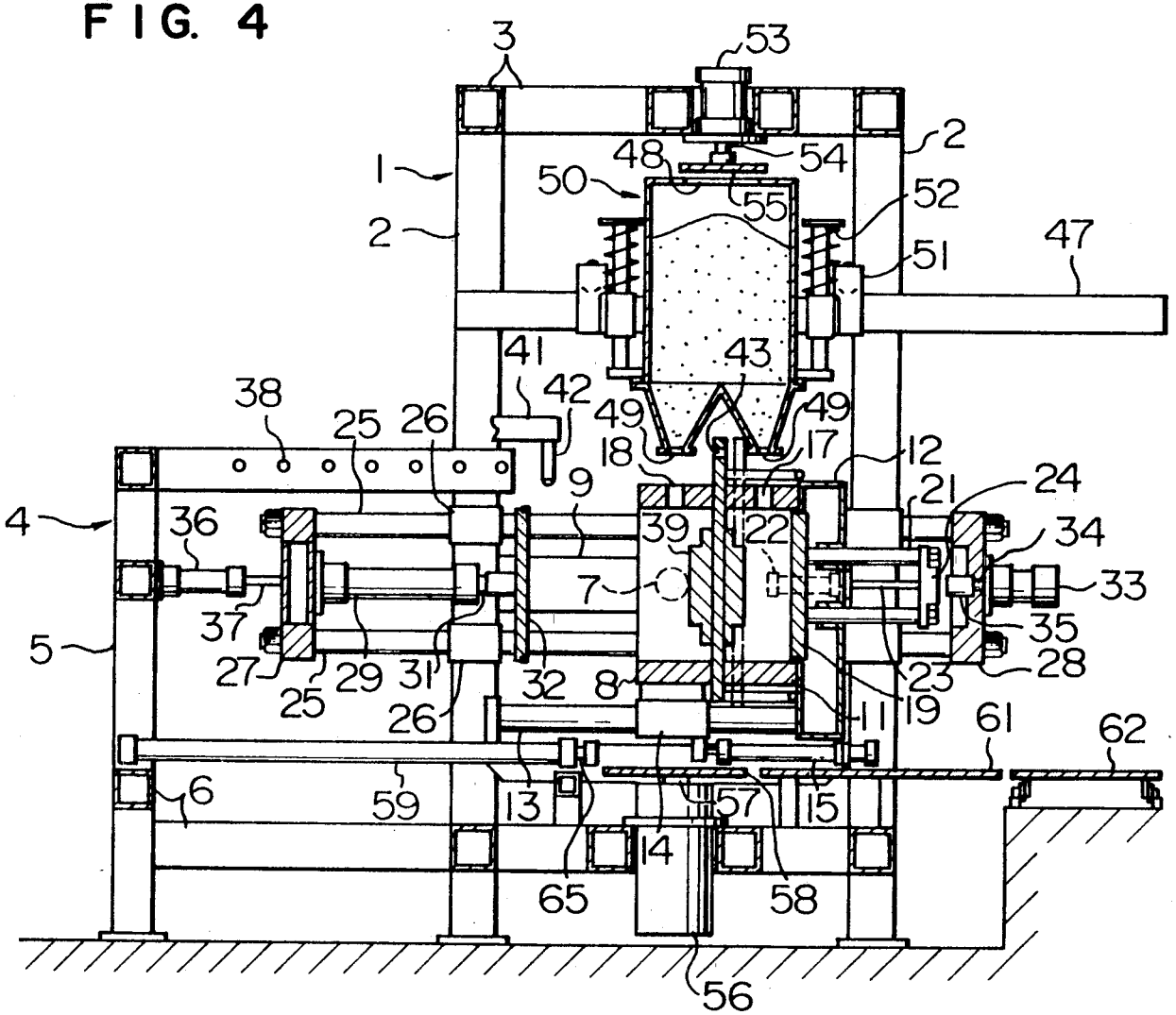

As a fourth manufacturing step, the blow head 50 is moved to a predetermined position in the main-gate type frame 1 by a drive means (omitted from illustration), that is, the sand blowing ports 49 of the blow head 50 are positioned above the sand charging ports 17 and 18 of the cope flask 11 and the drag flask 8 and as well as the sand inlet port 48 of the blow head 50 is positioned below the cylinder 53 (see FIG. 4).

As a fifth manufacturing step, the fluid circuit of the cylinder 22 is freed before the piston rod 34 of the cylinder 33 is extended. As a result, the squeeze head 35 at the free end of the piston rod 34 comes in contact with the connecting bracket 24 so that the connecting bracket 24 is pushed leftward. Therefore, the piston rod 23 of the above-described cylinder 22 is retracted so that the cope flask squeeze plate 19 is introduced into the cope flask 11 through the upper opening by a predetermined depth. Simultaneously, the piston rod 31 of the cylinder 29 is extended so that the drag flask squeeze plate 32 is introduced into the drag flask 8 through its lower opening by a predetermined depth. As a result, independent mold-half forming spaces are created in the space formed by the cope flask 11 and the drag flask 8 with respect to the match plate 39 serving as a boundary.

As a sixth manufacturing step, when the piston rod 54 of the cylinder 53 is extended, the pressure plate 55 disposed at the lower end of the piston rod 54 hermetically closes the sand inlet port 48 of the blow head 50, and as well as downward pushes the blow head 50 against the spring force of the spring members 52. As a result, the sand inlet ports 49 of the blow head 50 are allowed to abut against the sand charging ports 17 and 18 of the corresponding cope flask 11 and the drag flask 8.

Figure 5:
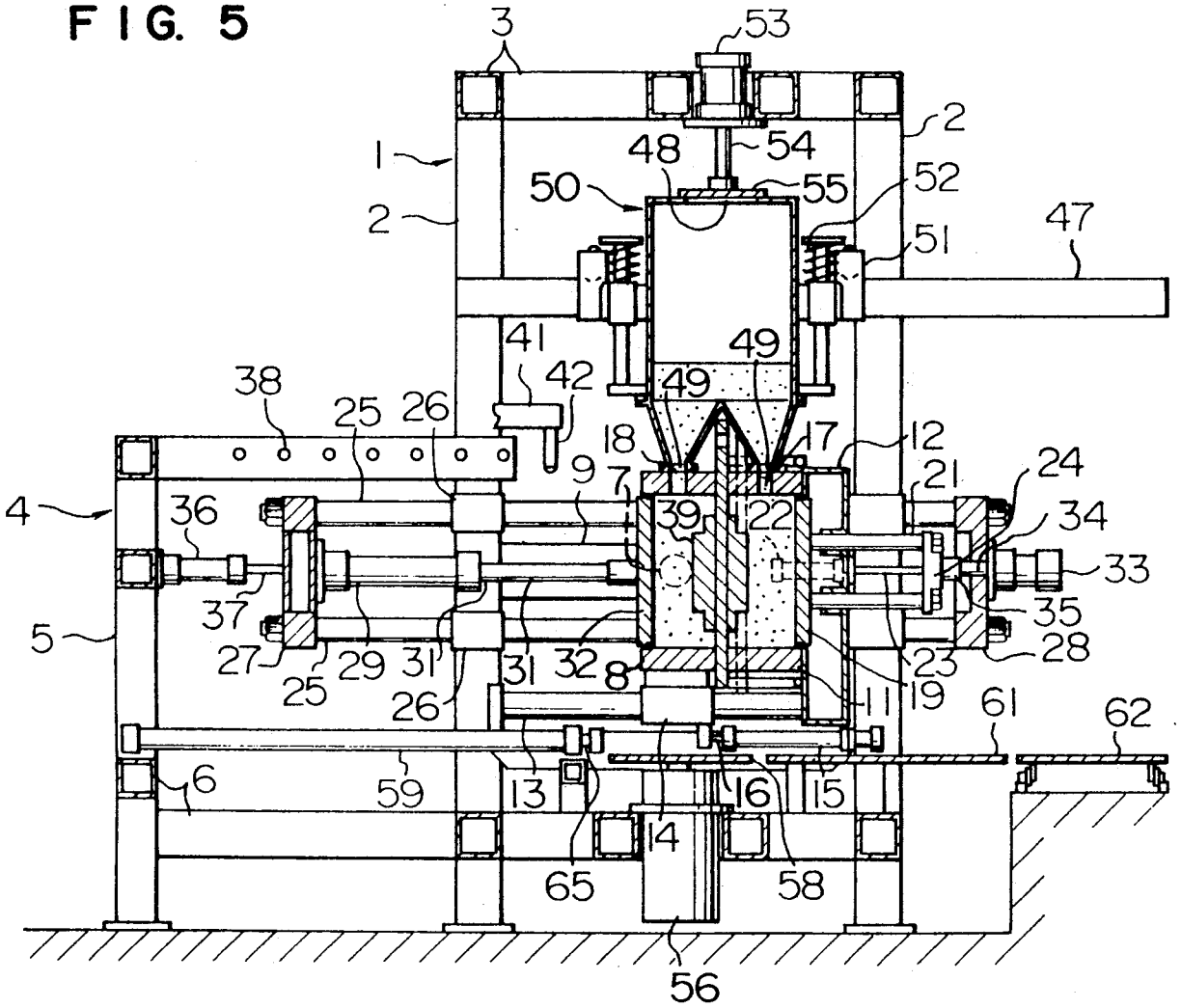
Figure 6:
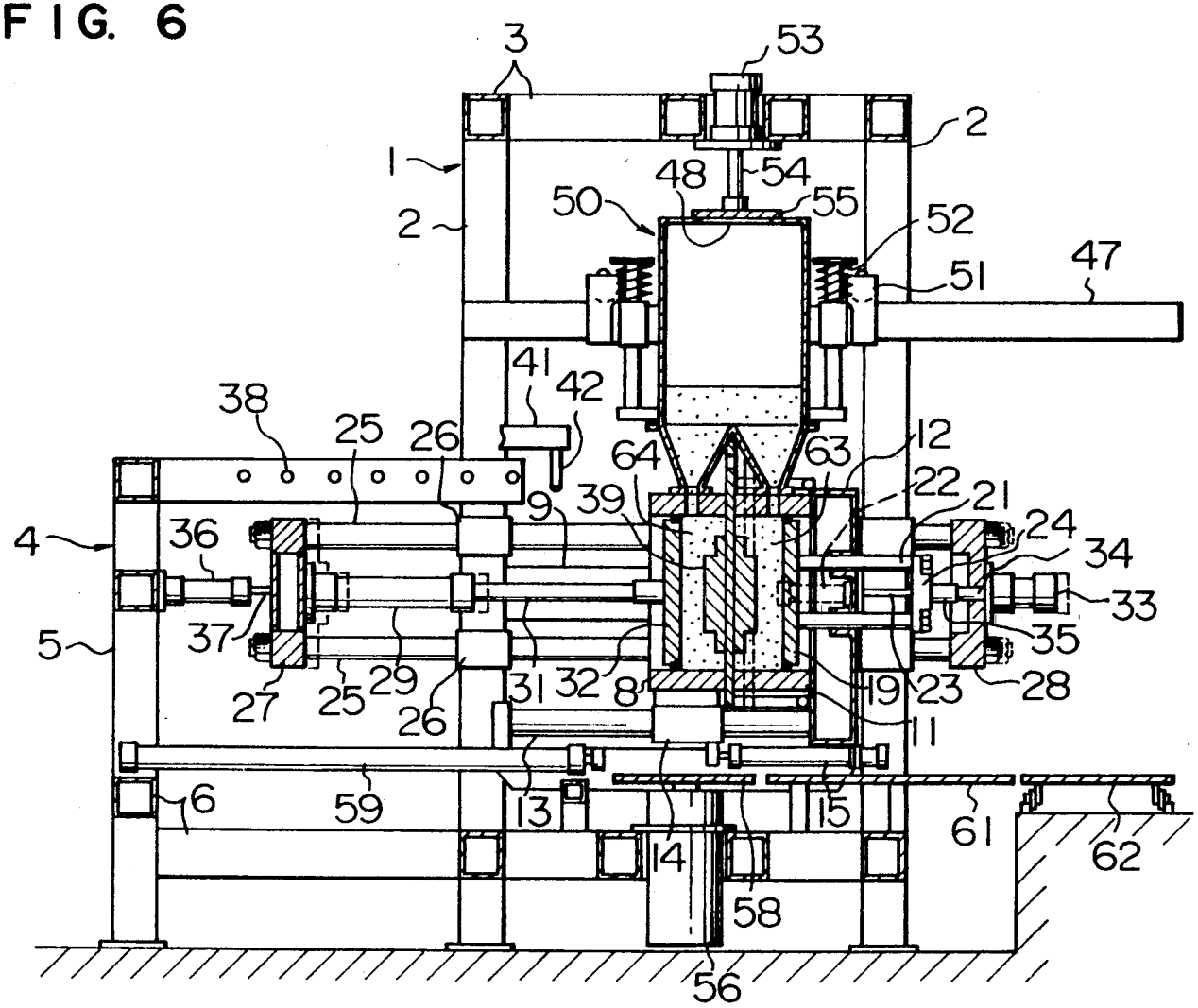
Figure 7:
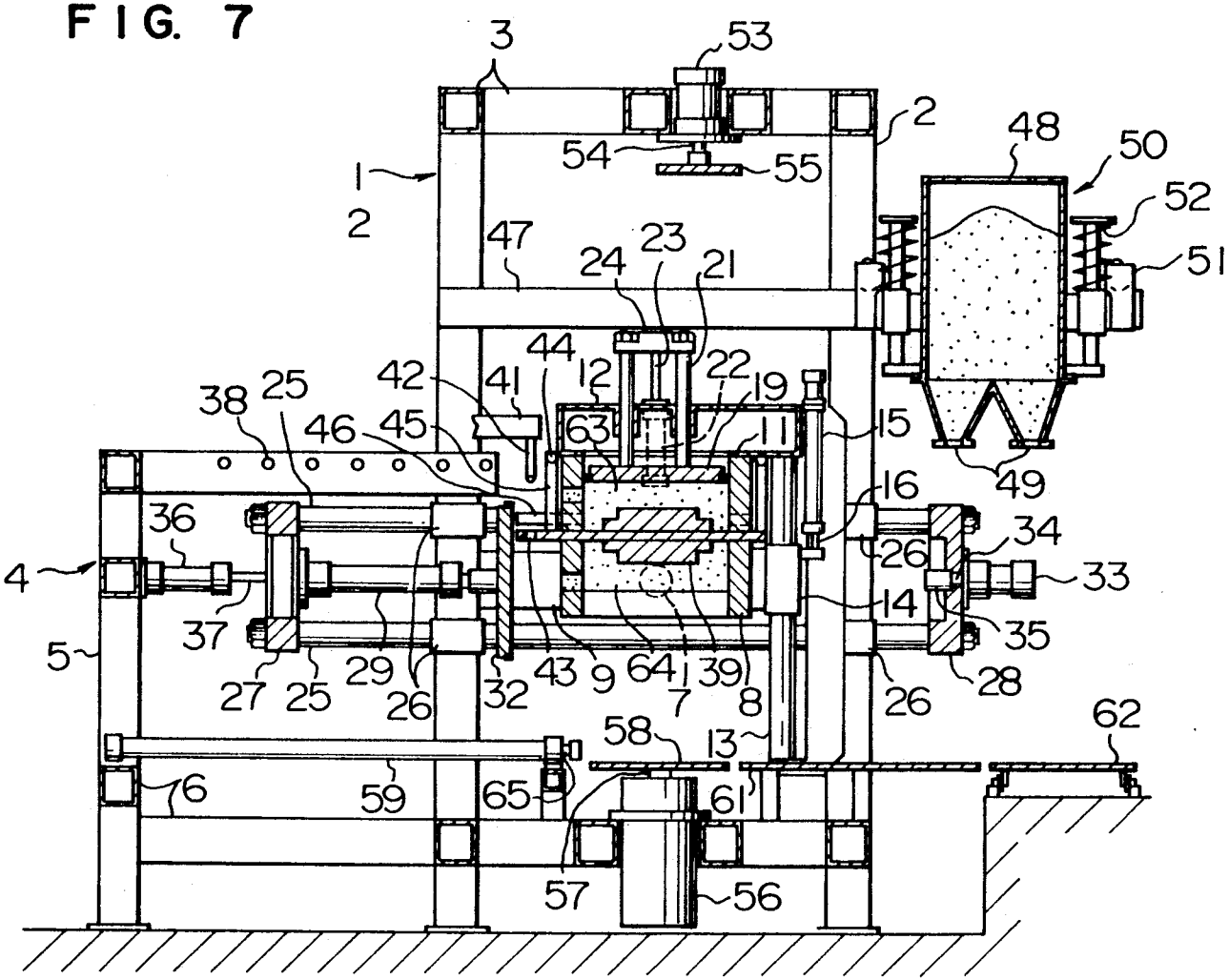
Figure 8:
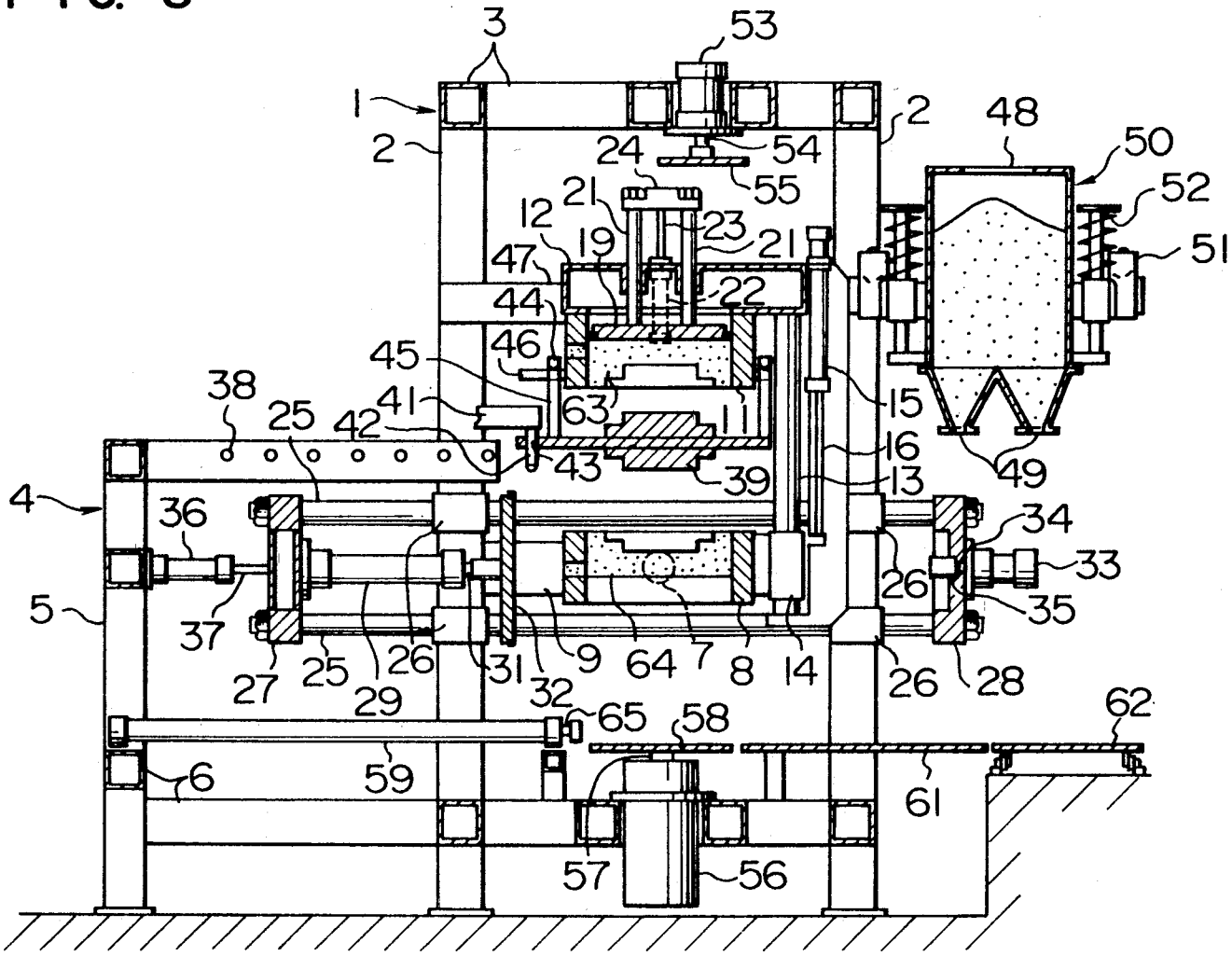

As a seventh manufacturing step, compressed air is, by a conventional means, supplied into the blow head 50 so as to charge the mold-half forming spaces created between the cope flask 11 and the drag flask 8 with the sand supplied through the blow head 50 (see FIG. 5).

As an eighth manufacturing step, while preventing rearward movement of the squeeze head 35 by the intermediate cut-off of the fluid pressure circuit of the cylinder 33, releasing the fluid pressure circuit for the cylinders 36, the piston rod 31 of the cylinder 29 is extended. As a result, the drag flask squeeze plate 32 at the free end of the piston rod 31 presses the charged sand in the drag flask 8. At this time, the side of the cylinder 29 opposite to the piston rod 31 and the left-hand die plate 27 are moved to the left by reaction force generated by the above-described cylinder 29. It leads to a fact that the right-hand die plate 28 and the cylinder 33 are also moved to the left. The thus-generated force is transmitted to the cope flask squeeze plate 19 via the squeeze head 35, the connecting bracket 24 and the guide rods 21. As a result, the cope flask squeeze plate 19 presses the charged sand in the cope flask 11 with substantially the same force caused from the drag flask squeeze plate 32 (see FIG. 6). As a result, a cope 63 is, by the compression, molded in the cope flask 11 and the drag 64 is molded in the drag flask 8.

After a predetermined time has passed, as a ninth manufacturing step, the drag squeeze plate 32 and the squeeze head 35 are returned to their original positions due to the retracting operations of the piston rods 31 and 34. Furthermore, the die bases 27 and 28, the guide rods 25 and the cylinders 29 and 33 are returned to the positions designated by a chain line shown in FIG. 6 by the extending operation of the piston rod 37 of the cylinder 36.

As a tenth manufacturing step, when the pressure plate 55 is moved upward by retracting the piston rod 54, the condition in which the pressure plate 55 is positioned in contact with the blow head 50 is released. Furthermore, the blow head 50 is raised due to the reaction force of the spring members 52, causing the condition in which the blow head 50 is positioned in contact with the cope flask 11 and the drag flask 8 to be released. Then, as an eleventh manufacturing step, the blow head 50 is moved to the position outside the main-gate type frame 1 in the rightward direction. Then, the sand is supplied into the blow head 50 by a sand supply means (omitted from illustration). In this state, as a twelfth manufacturing step, the cope flask fastening frame 12, the cope flask 11, the match plate 39 and the drag flask 8 are, by a rotation drive mechanism (omitted from illustration), counterclockwise rotated together by an angle of 90° (see FIG. 7).

As a thirteenth manufacturing step, the piston rod 16 of the cylinder 15 is extended, causing the cope flask fastening frame 12 and the cope flask 11 to be moved upward. As a result, the cope flask 11 and the match plate 39 are separated from each other. When the cope flask 11 is further moved upward, the rail 46 is engaged with the roller 44 of the suspending member 45 for the match plate 39. As a result, the match plate 39 is raised, causing the match plate 39 and the drag flask 8 to be separated from each other (see FIG. 8). At this time, the pin hole 43 formed in the match plate 39 and the pin 42 of the arm 41 are engaged with each other. When the cope flask fastening frame 12 and the cope flask 11 have been moved to their uppermost positions, the arm 41 is, by a drive means (omitted from illustration), retracted at the fourteenth manufacturing step. As a result, the match plate 39 is retracted to a position outside the main-gate frame 1 in the leftward direction.

At a fifteenth manufacturing step, when the piston rod 16 of the cylinder 15 is retracted, the cope flask fastening frame 12 and the cope flask 11 are moved downward, causing the mold surface of the cope 63 to be brought into contact with the mold surface of the drag 64.

Figure 9:
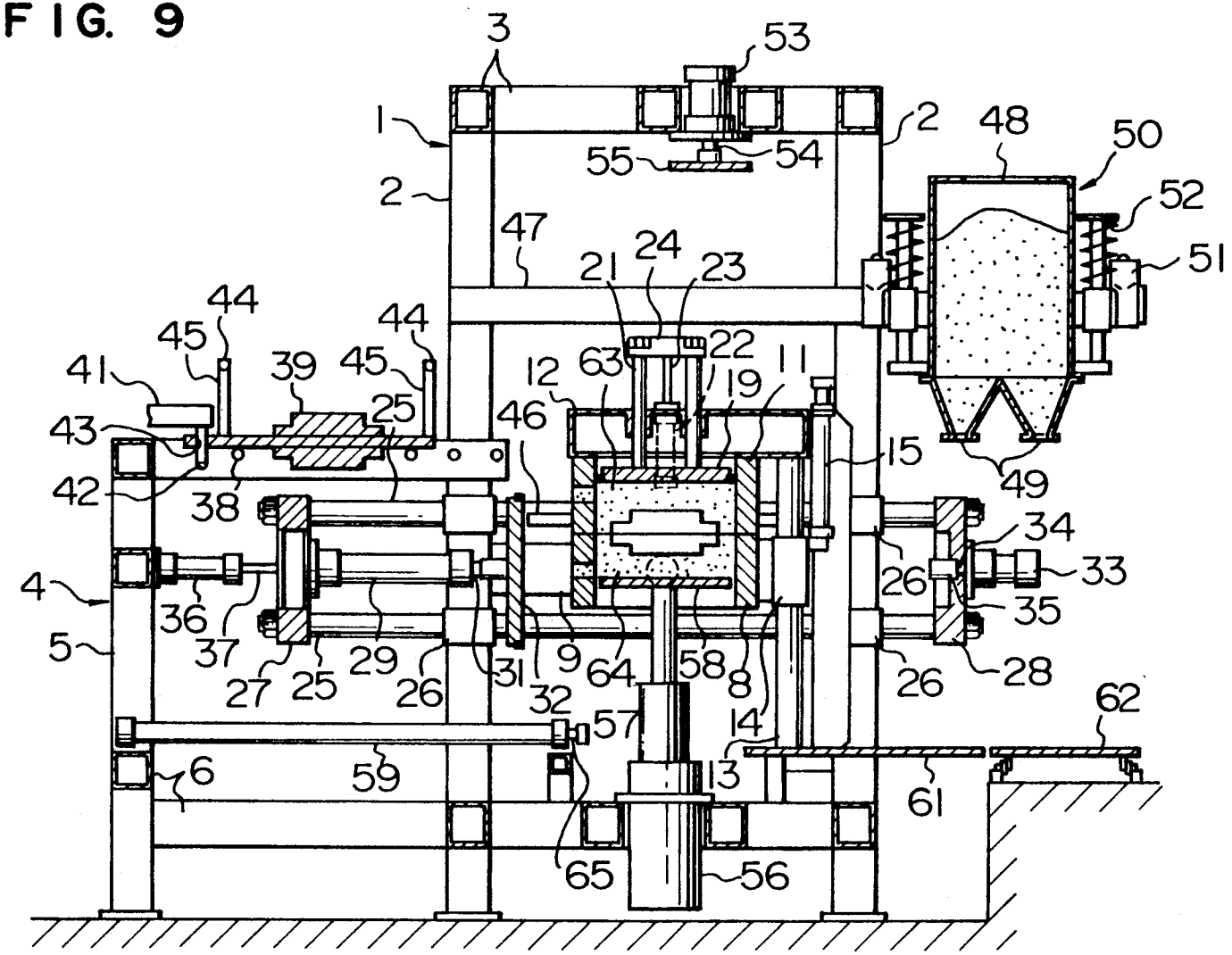

As a sixteenth manufacturing step, when the piston rod 57 of the cylinder 56 is extended, the table 58 is moved upward until it comes in contact with the back side of the drag 64 via the lower opening formed in the drag flask 8 (see FIG. 9).

As a seventeen manufacturing step, when the piston rods 23 and 57 of the corresponding cylinders 22 and 56 are synchronously retracted, the cope flask squeeze plate 19 is moved downward via the connecting brackets 24 and the guide rods 21. Furthermore, the table 58 is moved downward, causing the cope 63 and the drag 64 are separated from the cope flask 11 and the drag flask 8 respectively.

When the table 58 reaches its lowermost position, the piston rod 65 of the cylinder 59 is extended at an eighteenth manufacturing step. As a result, the cope 63 and the drag 64 placed on the table 58 are pushed toward the position on the mold carrier 62 via the transporting member 61. Finally, the piston rods 16 and 23 of the corresponding cylinders 15 and 22 are extended. Furthermore, the piston rod 65 of the cylinder 59 is retracted so that the original state shown in FIG. 1 is realized again.

While an assumption is made that the above-described steps establish one cycle operation, the cycle operation is repeated so that the flaskless molds are successively molded.

Although the above-described embodiment is arranged in such a manner that the sand blowing ports 49 formed in the blow head 50 are allowed to abut against the sand charging ports 17 and 18 of the corresponding cope flask 11 and the drag flask 8 so as to blow the sand and charge it, another structure may be employed. For example, nozzle ports, which can be inserted into the sand charging ports 17 and 18, are connected, while establishing communication, to the lower portion of the sand blowing ports 49. With this arrangement in which the nozzle ports thus-connected is inserted into the sand charging ports 17 and 18 so as to charge, sand by blowing, and the nozzle ports are disengaged from the sand charging ports. In this state, the charged sand cannot be left in the sand charging ports 17 and 18.

Although the invention has been described in its preferred embodiment form, it is understood that the present disclosure of the preferred embodiment form has been changed in the details cf construction and the combination and arrangement of parts may be resorted to without departing from the spirit and the scope of the invention as hereinafter claimed.

What is claimed is:

1. A flaskless molding machine comprising:

a drag flask arranged so as to be rotated between a horizontal position and a vertical position and having, on the side wall thereof, an opening for charging sand;

a cope flask capable of moving to and away from said drag flask, arranged to be rotated together with said drag flask and having, on the side wall thereof, an opening for charging sand;

a first plate inserted into said cope flask and capable of moving within said cope flask;

first drive means connected to said cope flask, for moving said first plate;

second drive means for downward moving said cope flask with respect to the position of said drag flask so as to realize a state in which a match plate is horizontally held between said drag flask and said cope flask;

third drive means for rotating said drag flask and said cope flask together to the vertical positions in a condition in which said match plate is held between said drag flask and said cope flask;

a second plate arranged to be inserted into said drag flask when the drag flask takes the vertical position;

fourth drive means for moving said first and second plates in such a manner that individual mold-half forming spaces are created in said cope flask and said drag flask with respect to said match plate serving as a boundary for charging said cope flask and said drag flask with sand through said corresponding opening for charging sand, and as well as molding, by compressing, a cope and a drag in said cope flask and said drag flask by pressing said first and second plates after said sand has been charged;

a table which can be moved up and down and is adapted to approach said drag flask when said cope flask and said drag flask are superposed and take their horizontal positions after said match plate has been removed; and fifth drive means for, when said first plate is downward moved by said first drive means, downward moving said table so as to cause said table to receive said cope and said drag respectively separated from said cope flask and said drag flask in such a manner that said cope and said drag are superposed.

* * * * *